United States Patent [19]

Uding

[11] 4,010,954

[45] Mar. 8, 1977

[54] BOARD GAME APPARATUS

[76] Inventor: Donald N. Uding, 5022 N. Springfield, Chicago, Ill. 60625

[22] Filed: Sept. 5, 1975

[21] Appl. No.: 610,622

[52] U.S. Cl. ..... 273/131 BB; 273/131 E; 273/131 K; 273/134 C; 273/134 B; 273/137 A

[51] Int. Cl.[2] ..... A63F 3/04

[58] Field of Search ..... 273/131, 134

[56] References Cited

UNITED STATES PATENTS

| | | | |
|---|---|---|---|
| 1,567,975 | 12/1925 | Muir | 273/134 AA |
| 2,990,181 | 6/1961 | Lippold | 273/134 AA |
| 3,037,773 | 6/1962 | Chambers et al. | 273/134 AA |
| 3,099,451 | 7/1963 | Newhouse | 273/134 AA |
| 3,223,420 | 12/1965 | Turner | 273/134 AA |
| 3,373,995 | 3/1968 | Fors | 273/134 AA |

*Primary Examiner*—Delbert B. Lowe

[57] ABSTRACT

A Monetary Acquisition Board Game in which financial gain is received by payment from a bank after purchase of property rights in specific pieces of property placed around the game board. The value of the property to be purchased and the pre-conditions for purchase are determined by value tokens which are randomly selected by players upon landing on the property during the course of the play. Movement of the players and satisfaction of the pre-conditions necessary for purchase of the property necessitates payment by the player into the bank.

9 Claims, 11 Drawing Figures

BOARD GAME APPARATUS

This invention relates to a monetary acquisition board game featuring the purchase of property rights, and, in a particularly preferred embodiment, a space travel game in which the property rights obtained relate to the colonization of planets.

Board Games such as "Monopoly" (A Trademark of Parker Bros. Games) are well-known examples of games which relate to the acquisition of property and the obtaining of income by travel of tokens around a pre-selected path. The status of all of the individual pieces of property in the Monopoly Game is fixed and unchanging, as is the route taken by the markers moved by the individual participants in the game.

Space Travel Games of various sorts have also been known in the past. Examples of these games may be found in U.S. Pat. Nos. 1,538,134; 3,037,773; 3,099,451; 3,223,420 and 3,522,628. In particular, U.S. Pat. No. 3,223,420 introduces a concept in extremely limited manner of requiring payment for departure from predetermined loci along a game route.

The game according to this invention, in a particularly preferred embodiment, utilizes the principle of random direction of movement along a Board having specific pieces of property, but with the property having no value established before the playing of the game itself. In this game, the value of the pieces of property is determined by actions of the players in uncovering value tokens. The consequence of this action is a Board having different value assessments for each piece of property in each game. Another novel feature in this game resides in the requirement that each movement by the players in their attempts to satisfy the pre-conditions for purchase of property requires payment.

A third feature of this invention involves the player's ability to, by payment of a fee, choose his rate of movement and the level to which he can obtain property rights. In a currently particularly preferred embodiment of this game, the property or property rights involved relate to the colonization of planets, with the movement of the players being made by space ship markers and the particular disideradum for which this game is directed is the colonization of the planets to obtain the property rights involved.

The particular game concept will be described in the context of the planetary exploration game idea, but the particularly novel features as outlined above, e.g., the random movements, random valuation and payments for movements concepts, can be applied to games with other travel and property acquisition motifs, as will be apparent to those with reasonable skill in the art. This invention will be more readily understood by reference to the drawings in which.

Figure 3:
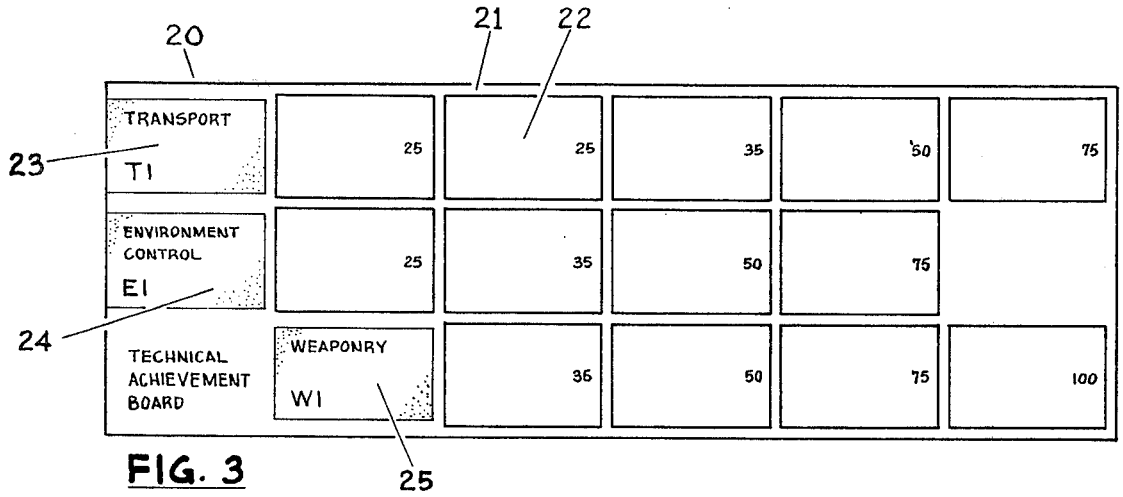
FIG. 3 is a view of the technical achievement board which may be utilized in conjunction with the subject invention.
Figure 4A:
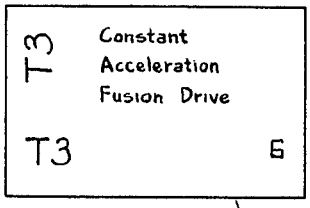
Figure 5:
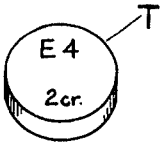
Figure 6:
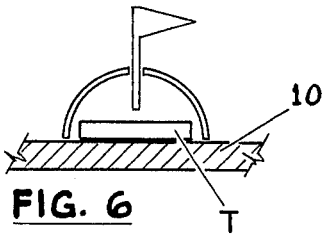
Figure 7:
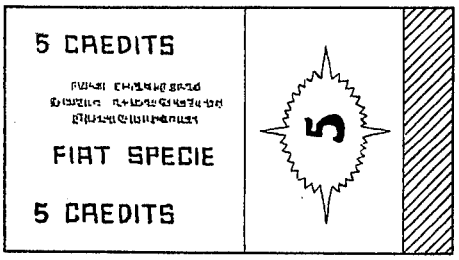
Figure 8:
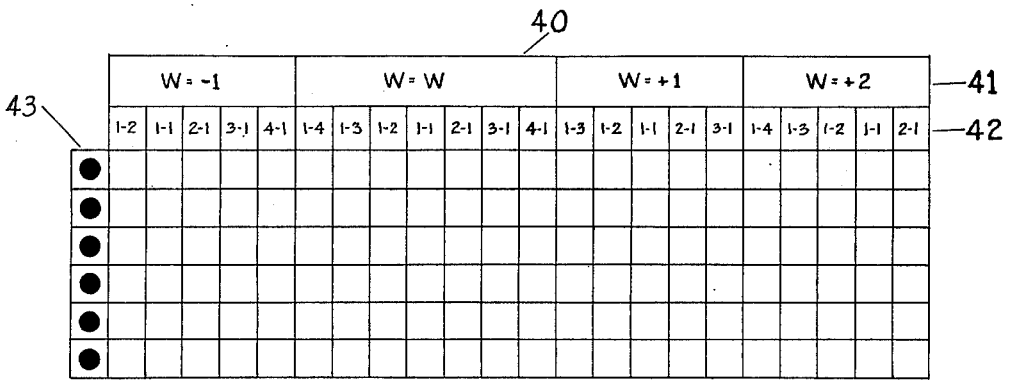
Figure 9:
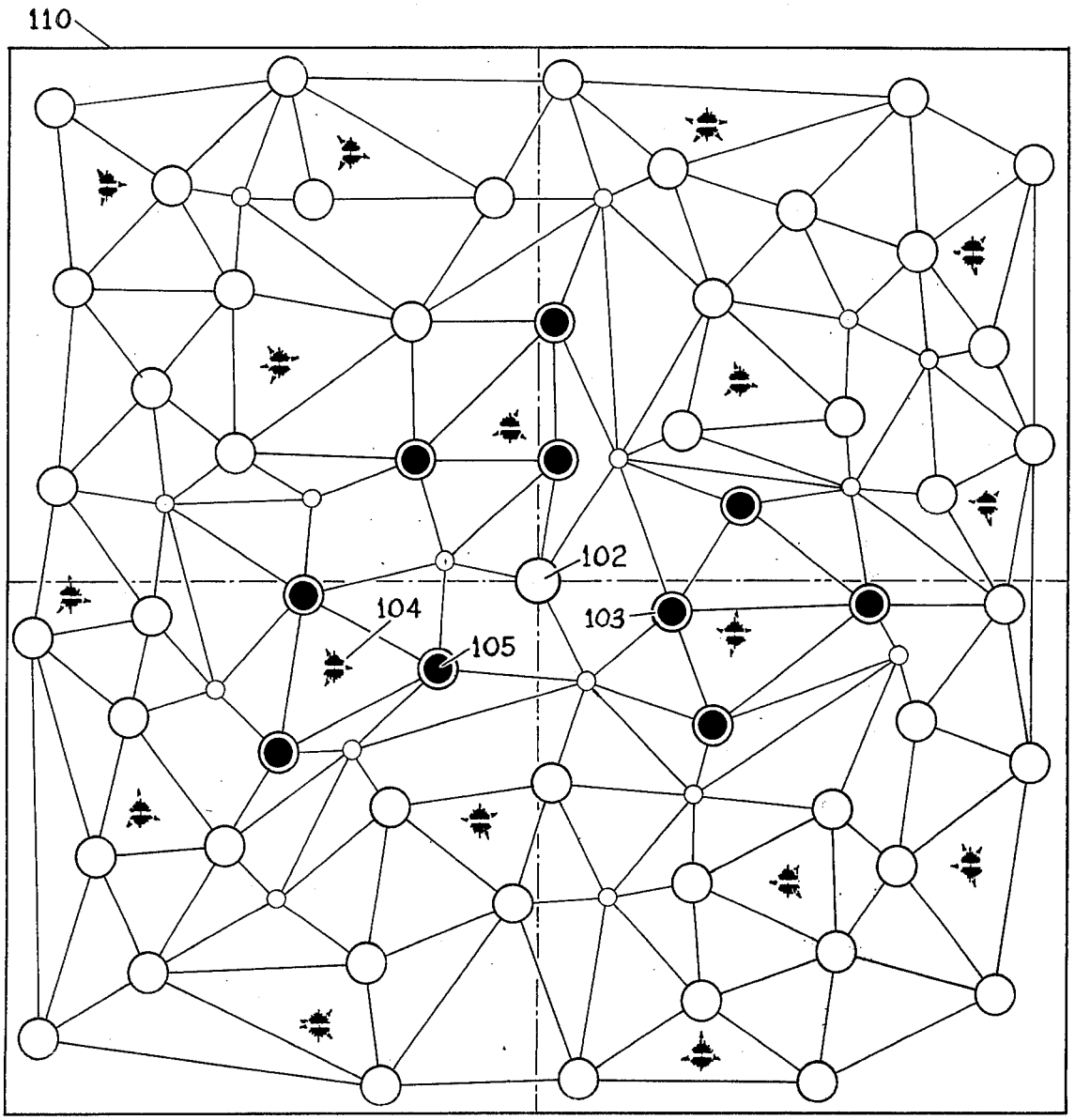

FIGS. 4*a*, *b* and *c* illustrate indicia used in conjunction with the board in FIG. 3;

FIG. 5 illustrates a value token utilized in this invention;

FIG. 6 illustrates a colonization marker;

FIG. 7 provides an illustration of the scrip used in the subject invention;

FIG. 8 illustrates the format of the table of results for another optional variant of the subject invention involving the utilization of combat by one player against another in an attempt to gain control of planets which have been colonized by the player's opponent;

FIG. 9 relates to another embodiment of the game board of this invention.

Figure 1:
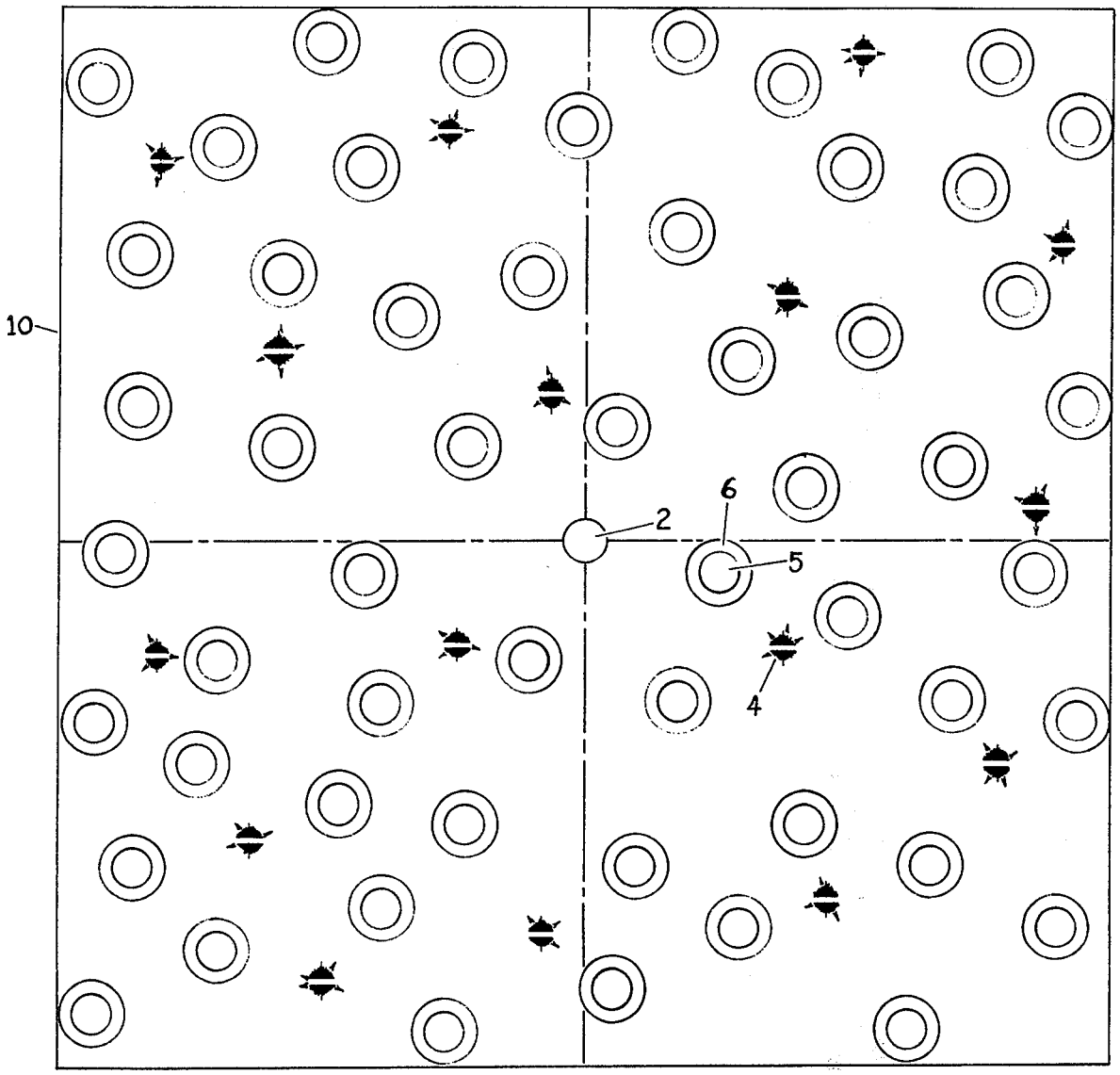
FIG. 1 is a plan view of an embodiment of the game board of this invention.
Figure 2:
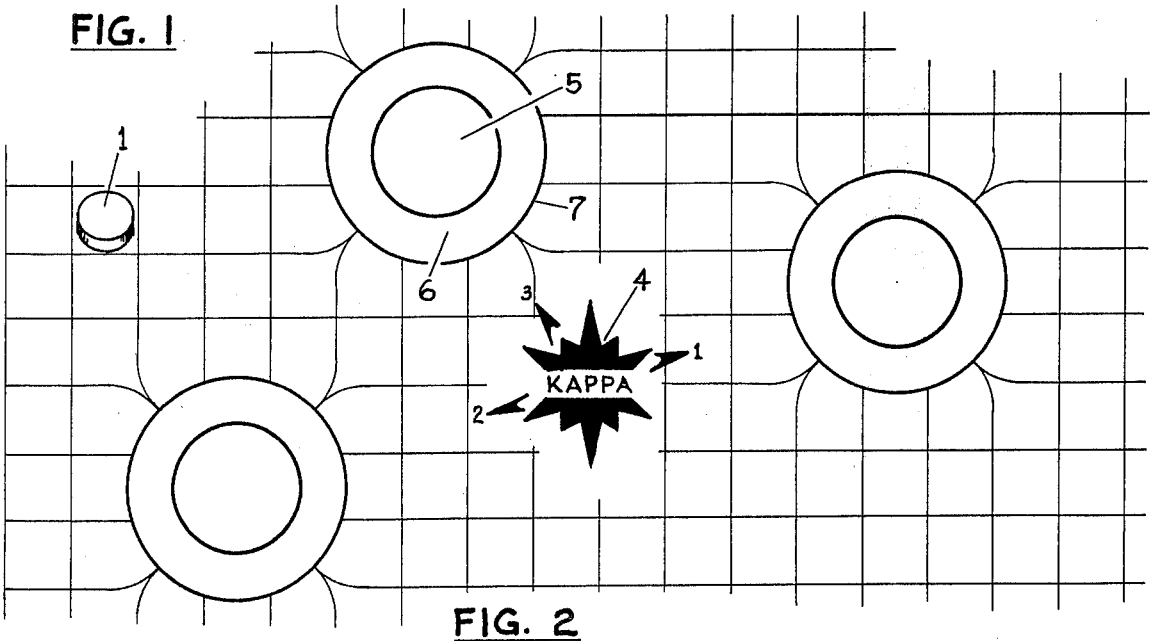
FIG. 2 is an enlarged plan view of a segment of the game board of this invention.
Figure 4B:
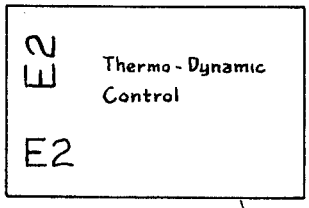
Figure 4C:
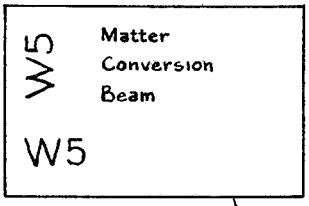

The game is initiated by each player moving in turn one space from the home planet 2 which is preferably located in the approximate center of the playing board area 10 as shown in FIG. 1. The initial goal of the players is to place the marker 1 on the planet 5. As can be seen from FIG. 1, the planet 5 is randomly spaced from stars 4. As illustrated in FIG. 2, there is orbital space 6 formed by an orbital boundary which meets the varying paths leading to the planet 5. This orbital space 6 imposes particular movement restrictions upon markers entering it and is significant when the variation of the game involving combat situations is utilized. The markers, e.g., ships, have means of identification such as different colors or shapes to allow players to identify them. It should be noted that to accelerate the speed in which the game is played, it might be desirable for each player to utilize more than one starship in the course of play. As can be seen from FIG. 2, the particular planet, in this embodiment, is identified by the name of the star and a directional number, i.e., Kappa Planet 1, 2 and 3. The first time a particular planet is landed upon by one of the players, that player draws a token T from the group of several such tokens which have been placed face down near the playing surface. The player observes the face of the token and places it face down on the planet space 5 where it remains for the balance of the game. The token, as illustrated in FIG. 5, has two separate designations. The designation 2*cr* is reflective of the value the bank must pay the colonizer of the planet after each of his turns after colonization has been completed. The designation E4 can be best understood by referral to FIGS. 3 and 4*b*. For a player to colonize a planet on which he has landed, it is necessary for the player to have obtained an environmental control level comparable to the environmental level shown on the token T assigned to that planet. Environmental control levels are indicated by sequentially numbered E indicia 11 as shown in FIG. 4*b*, which the player purchases in sequence and displays on his Technical Achievement Board (hereinafter TAB) 20, shown at FIG. 3. Thus, in the examples illustrated; if the planet landed upon held token T with an environmental level of E4 and a player held only E indicia 11 with an environmental control level of E2 on his TAB 20 he could not colonize that planet. If, however, his TAB held E indicia for levels E3 and E4 in addition to the indicia 11 shown he could in fact colonize the planet.

To colonize a planet a player must have moved his ship marker over the planet space 5, demonstrated the match between the environmental control level of an E indicia on his TAB and the environmental level shown on the token T assigned to that planet. He must also pay a fixed colonizing fee as indicated by the instructions. Upon completion of these conditions, the player places a colonization marker, as depicted in FIG. 6, over the planet space 5. The colonization marker may consist of, e.g., a plastic cover supporting a flag bearing some designation correlating it to the ship markers 1 used by the respective players.

The TAB 20 illustrates the multiplicity of the levels of technical achievement to be obtained in the preferred embodiment of this game. Each player is provided with a TAB which he keeps near the playing surface on which he displays technical achievement tokens he has purchased so that the other players can observe it. The TAB also displays token purchase price and serves to control the purchase of tokens as will be discussed below.

As illustrated in FIG. 3, there are three facets of technical achievement levels, represented on the TAB 20 by horizontal rows, and in one embodiment of this game, it is essential that the game contain the technical achievement levels represented by transportation as shown by identifying face surface 23 and environmental control illustrated at identifying face surface 24. The weaponry technical achievement level illustrated by face surface 25 on the board is an optional and preferred embodiment which relates to the variant of combat between players. This will be discussed in more detail below. The TAB 20 includes a raised frame area 21 forming a plurality of pockets 22 in which technical level tokens 11, 12 and 13 are placed in sequential order of levels as they are purchased by the player. The values shown in pockets 22 are illustrative of the purchase prices necessary to obtain each of the particular achievement levels.

In a preferred variation of the game, any particular player may not exceed the technical achievement of one facet of the TAB by more than two levels of any other facet. In other words, if environmental control has reached the third level, before the particular player can increase it to the fourth level, he must raise the transportation level of achievement to the second level. This feature acts as a restraint on overdevelopment in any one facet of technical achievement.

Another novel feature of this invention resides in the fact that only players landing on any given planet are aware of the environmental characteristics of that particular planet. For example, if there are six players in the game, and player No. 1 lands on a planet, draws a token but does not colonize, he places the token face down on the planet. After such action is taken, therefore, players 2 through 6 are not aware of the environmental control level and value of that planet. If player No. 2 subsequently lands on the planet, he is then allowed to discover the environmental control and value character of the planet by viewing the face of the token, but the remaining players, not having landed on the particular planet, are not informed.

During the course of play it is necessary for the players to pay for each particular move made by each marker. A player may increase the effectiveness of his movement payment by increasing the rate of movement allowed his ship through purchase of higher transportation facet levels. For example, all players begin with a rate of movement of one space per turn. By purchasing transportation indicia cards 12 for the prices shown in TAB pocket 22, the player is allowed to move his ship at the rate shown on their face, e.g., with the T indicia card illustrated in FIG. 4*a*, the figure in the lower right hand corner would allow a movement rate of 6 spaces per turn. During the course of the game, therefore, each player has alternative methods of spending money in order to reach planets and establish colonies. He may, for example, purchase additional ships, increase the rate of movement of the ships, increase the level at which he may purchase explored planets or increase his level of environmental control. However, he may exhaust his resources through over extension of exploration rate or colonization levels, and the game terminates for that player.

To increase the random nature of the subject game, a series of random occurrence situations may be introduced into the board play. At predetermined intervals one of the players utilizes a chance means to select instructions concerning special occurrences, e.g., hazards such as movement restrictions, removal of ships, etc. Random occurrence instructions may apply only to one quadrant of the game board determined as part of the chance means selection.

FIG. 8 illustrates a combat table 40 utilized for the embodiment of the subject application in which weapons are involved and planets may be taken from the original colonizer. In this embodiment, ships of one player may attack the colony of a second player. This attack is accomplished by placing ships at the orbital space 6 around the planet. The result of the assault of the ships upon the colony is resolved during the turn of the player owning the ship while the countering assault of the colony upon the ship is resolved during the turn of the colony owner. The content of the combat table 40 provides properly weighted probabilities for various relationships of ships, colonies, and weaponry levels; the result of a specific battle being determined by correlating table content with a chance means, i.e., spinner, dice, etc. The relationship of differing weaponry levels between the two players involved is determined within the first row 41 of reference table 40. The numerical relationship between the particular parties involved, wherein ships have a factor of one and colonies a factor of two is determined within the second row 42. The markings in the vertical column 43 correlate with the markings on the chance means. For example, if a player were to initiate an attack upon a colony by moving four ships onto the orbit ring 6 of the planet, he would, after completing all movement, obtain the result of his assault in the following manner: the two players involved would first compare the highest W indicia 13 displayed in their respective TAB's 20 with indicia they had purchased during the course of the game. If the attacking player's weaponry level were one higher, say, W3, than that of the defender, holding W2, he would select the column W=1 from row 41 of table 40; possible results in this column being weighted in favor of a successful result for the attacker. Next, the numerical relationship would be established, the attacker having four ships with a factor of one and the defender having one colony with a factor of two, the ratio would then be two to one in favor of the attacker. In row 42 of table 40 the attacker would select the subordinate 2-1 column within the previously selected primary column and the results shown therein, which are further weighted in favor of the quantitatively superior opponent, would be those to be selected based upon the horizontal correlation with the number in column 43 which matches that produced by the attacker's use of the chance means. In this manner, a singular instruction, i.e., defender captured, defender destroyed, no effect, would be procured, which would be suitable to the qualitative and quantitative relationship of the players engaged in such combat.

FIG. 9 illustrates a further game board embodiment 110 in which the paths for movement are somewhat more restricted than in the game board illustrated in FIG. 1. The paths from one planet 105 to another planet 105 around a particular star 104 may require traversing of a third planet. This board is more particularly susceptible to a further variant in which landing on a colonized planet of another results in payment of a fine or excluding passage by the landing player. It is possible, of course, to have planets which may be attacked and others which may not be, in a particular Game Board, although it is preferred that the game be played with all planets either susceptible to attack or without the weaponry-attack option discussed previously.

I claim:

1. A monetary acquisition board game played by at least two players comprising:

a. a board with property sites and paths for random multidirectional movement toward any of a plurality of said property sites;

b. at least one marker for each player for representation of said movement;

c. first indicia having rates of movement for the markers of each player; and d. second indicia displaying the acquisition status obtained by each player, with said acquisition status governing the type of property rights which may be purchased by each player.

2. The game of claim 1 in which there are more markers than players at the beginning of the game and players may purchase additional markers or added movement.

3. The game of claim 1 which includes a random occurrence means which is utilized after a pre-determined number of turns and in which one player determines the occurrences for all players in a given sector of the board.

4. The game of claim 1 in which the board represents space travel, the property to be acquired is colonization rights of planets, and the other components of the game reflect the space travel concept of the game board.

5. A monetary acquisition board game played by at least two players, said game including the obtaining of financial gain by payment from a bank after each play as a result of the purchase of property rights and purchasing of the right to move by each player for each of his turns, said game comprising:

a. a board with property sites and paths for random multidirectional movement toward any of a plurality of said property sites;

b. at least one marker for each player for representation of said movement;

c. value tokens for correlation with specific pieces of property through random selection by a player when his marker lands on said specific piece of property, said property having no ascribed value prior to said landing, said tokens having inscribed thereupon an owner income amount and an acquisition status designation.

6. The game of claim 5 which further comprises:

a. first indicia having rates of movement for the markers of each player;

b. second indicia having the acquisition status designations shown on said value tokens; said acquisition status and said rates of movement obtained by purchase.

7. The game of claim 1 which includes at least two racks, the game designed to provide each player with a rack, each rack comprising pockets for display of first and second indicia in a predetermined order.

8. The game of claim 1 in which each player begins with an equal plurality of position markers, each of which may be moved independently during each player's turn and in which additional position markers may be purchased during the course of play with the rate of movement for each position marker governed by said first indicia.

9. The game of claim 1 in which position markers may be removed from the game board and ownership of property change hands through combat situations regulated by the relative placement of the opposing player's position markers with the results governed by the use of chance means to select at random instructions from a table of possible resolutions, and further including:

a. third indicia indicating on a face thereof at least three weaponry effectiveness levels whose possession by opposing players establishes a relationship which dictates categories of said table from which random selection may be made; and b. a rack for each player comprising pockets for display of first, second and third indicia in a predetermined order.

* * * * *